US007935875B2

(12) United States Patent
Komatsu

(10) Patent No.: US 7,935,875 B2
(45) Date of Patent: May 3, 2011

(54) KEY ACTUATING APPARATUS

(75) Inventor: Akihiko Komatsu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/561,146

(22) Filed: Sep. 16, 2009

(65) Prior Publication Data

US 2010/0000394 A1 Jan. 7, 2010

Related U.S. Application Data

(62) Division of application No. 12/053,068, filed on Mar. 21, 2008, now Pat. No. 7,858,864.

(30) Foreign Application Priority Data

Mar. 23, 2007 (JP) ..... 2007-077042
Mar. 11, 2008 (JP) ..... 2008-061038

(51) Int. Cl.
*G10F 1/02* (2006.01)

(52) U.S. Cl. ..... 84/33; 84/439

(58) Field of Classification Search ..... 84/33, 439; 335/229

See application file for complete search history.

(56) References Cited

U.S. PATENT DOCUMENTS 4,319,211 A * 3/1982 Ueda et al. ..... 335/229
5,210,367 A * 5/1993 Taguchi et al. ..... 84/746
5,650,580 A * 7/1997 Yamamoto et al. ..... 84/21
5,922,983 A 7/1999 Muramatsu
6,121,535 A 9/2000 Muramatsu

FOREIGN PATENT DOCUMENTS

JP 5011765 1/1993
JP 2002343630 A * 11/2002

* cited by examiner

*Primary Examiner* — Jianchun Qin
(74) *Attorney, Agent, or Firm* — Morrison & Foerster LLP

(57) ABSTRACT

In order to improve a touch of a key of a keyboard musical instrument by using a key actuating apparatus which actuates the key supported so as to be rotationally movable with regard to a frame of the keyboard musical apparatus, a key actuating apparatus (1) includes: a plunger (15) which is moved on an arc or curved line in correspondence with a rotational motion of a key (3); and a solenoid (7) including electro magnets (17 and 19) which are fixed to the frame and which are substantially in a cylindrical shape into which the plunger is inserted. The plunger (15) is formed in an arc or curved shape extended in a direction of a rotational motion of the plunger (15). A head end (15*b*) arranged on the plunger (15) in a lengthwise direction is made from a magnetic body.

7 Claims, 8 Drawing Sheets

KEY ACTUATING APPARATUS

CROSS-REFERENCE TO RELATED APPLICATIONS

This application is a division of U.S. patent application Ser. No. 12/053,068 filed Mar. 21, 2008, the entire disclosure of which is incorporated herein by reference.

BACKGROUND OF THE INVENTION

1. Field of the Invention

The present invention relates to a key actuating apparatus.

Priority is claimed on Japanese Patent Application No. 2007-077042, filed Mar. 23, 2007 and Japanese Patent Application No. 2008-061038, filed Mar. 11, 2008, the content of which is incorporated herein by reference.

2. Description of the Related Art

In general, a natural keyboard musical instrument such as an acoustic piano has a constitution in which, for example, a natural sound is generated by hitting a string with a rotationally movable hammer when a key is pushed. Such a natural keyboard musical instrument has an action mechanism between the key and the hammer. The action mechanism affects a special reacting force (braking force of the key) on a player via the key. In other words, the natural keyboard musical instrument has its own touch of the key because the instrument has an action mechanism.

On the other hand, a conventional electric keyboard musical instrument such as an electric keyboard which generates an electric sound has a mechanical portion such as a spring and a weight member for returning the key to its initial position. Moreover, the conventional electric keyboard musical instrument has a constitution in which, the player operates the key while acting against the reacting force of the spring, the weight member, and the like, upon pushing the key. Therefore, the touch of the key of the electric keyboard musical instrument is greatly different from the touch of the key of the natural keyboard musical instrument.

There is prior art (for example, see Patent Document 1 below) which has an object to obtain the same touch of a key as the natural keyboard musical instrument even by using an electric keyboard musical instrument. In the prior art, a key actuating apparatus and a control apparatus of the key actuating apparatus for applying a reacting force against a pushing force on the key by actuating the key are proposed. Moreover, in the prior art, a key actuating apparatus which is an electromagnetic actuator of a solenoid type is used.

With regard to the constitution of such prior art, for example, as shown in Patent Document 2 shown below, a plunger which constitutes the solenoid is connected to the key so as to change or adjust the reacting force. In such a case, the key has a rotation axis which is a fulcrum for a rotational motion, and is connected to the linearly movable plunger of the solenoid via a sliding mechanism which is constituted from multiple members (such as intermediate members and an axis). In other words, the sliding mechanism is an absorber of a difference or gap which is caused at a connection point between the rotationally-movable key and the linearly-movable plunger.

[Patent Document 1] Japanese Patent No. 3772491

[Patent Document 2] Japanese Patent No. 3191327

However, in a case such as shown in Patent Document 2 in which the plunger and the key are connected via the sliding mechanism constituted from multiple members, there is a possibility in which a backlash is caused among the multiple members. In such a case, it is hard to control a key-actuating operation by the control apparatus, and therefore, there is a problem of causing unnatural or uncomfortable touch of the key when a player pushes the key.

SUMMARY OF THE INVENTION

The present invention was conceived in order to solve the above-described problem and has an object to provide a key actuating apparatus which improves the touch of a key.

In order to solve the above-described problem, the present invention provides, for example, the following solutions.

A first solution is a key actuating apparatus which actuates a key that is rotationally movable and is supported and attached to a frame, including: a plunger which is rotationally moved in correspondence with a rotational motion of the key, and which is formed in an arc shape extending in a direction of a rotational motion of the plunger; a solenoid fixed to the frame and comprising an electro magnet which is substantially in a cylindrical shape and into which the plunger is inserted; and a first end of the plunger in a lengthwise direction which is a direction of rotational motion being made from a magnetic body.

Moreover, a second solution is preferably the above-described key actuating apparatus further including a weight member which is linked to the key, which is supported and rotationally movable in response to a rotational motion of the key and which applies a force on the key in one direction due to the weight of the weight member, wherein the plunger is formed in an arc shape around a fulcrum axis of the weight member, and a second end of the plunger is fixed to the weight member by being integrally formed with the weight member.

It should be noted that the weight member connected to the key has a function of causing a reacting force by applying the weight of the weight member against a pushing operation on the key by a player so as to rotationally move the key in another direction of a rotational motion of the key.

A third solution is preferably the above-described key actuating apparatus wherein, the plunger is formed in an arc shape around a fulcrum axis of a rotational motion of the key, and a second end of the plunger is fixed to the key by being integrally formed with the key.

In accordance with the above-described key actuating apparatus, a magnetic force of the electro magnet affects one end of the plunger when a current is applied to the electro magnet, and therefore, the key is actuated because the plunger moves on an arc or curved line. Here, the plunger is formed in an arc or curved shape which is appropriate to the rotational motion of the key and/or the weight member. Therefore, even if the plunger is integrally fixed to the key or the weight member, it is possible to insert the plunger inside the electro magnet in a cylindrical shape.

Moreover, when a player pushes the key, the plunger in an arc or curved shape is moved on an arc or curved line along with rotational motion of the key. Therefore, in the same manner as described-above, even if the plunger is integrally fixed to the key and/or the weight member, it is possible to insert the plunger inside the electro magnet in a cylindrical shape.

A fourth solution is preferably the above-described key actuating apparatus, and if the plunger is integrally fixed to the key, the plunger is linked to the key and is supported and rotationally movable in response to a rotational motion of the key. It is preferable that a weight member is provided which is linked to the key, which is supported and rotationally movable in response to the rotational motion of the key and which applies a force on the key in one direction due to a weight of the weight member, wherein the plunger applies a force on the key in another direction due to the weight of the plunger.

In accordance with such a constitution, the plunger has a function of a counterweight with regard to the weight member. In addition, due to a weight including both the weight member and the plunger, a moment of inertia of a whole system including the key and the weight member is increased. Therefore, without fixing another weight member to the key, it is possible to improve the touch or the feeling of weight while pushing the key by a finger, and it is possible to improve feeling of the player while playing the keyboard musical instrument.

A fifth solution is preferably the above-described key actuating apparatus wherein, the first end of the plunger is formed to have a larger diameter than the diameter of other portions of the plunger.

In such a case, even if the plunger is produced by using a magnetic body as a whole, the largest portion of the magnetic force of the electro magnet affects on the one end of the plunger. Therefore, it is possible to reliably move the plunger on an arc or curved line. Moreover, it is easy to produce the plunger because the plunger is produced by using a magnetic body as a whole. Therefore, it is possible to improve the productivity of the key actuating apparatus and reduce production costs.

It should be noted that if the plunger fixed to the key has a function of a weight member, it is possible to effectively increase the weight of the plunger by forming the plunger to have a large diameter as described above.

A sixth solution is preferably the above-described key actuating apparatus wherein, the plunger is arranged at a position closer to outside of the arc shape rather than the center of a cross-section of the electro magnet which orthogonally crosses a lengthwise direction of the plunger.

If the electro magnet is constituted by winding a coil wire (conductor wire for constituting a coil) multiple times in order to provide a coil so as to be the same cylindrical shape as the plunger, the density of the coil of the electro magnet is different between a side close to an inside edge and a side close to a peripheral edge of the cylindrical shape. Therefore, the magnetic field strength at the side close to the inside edge is stronger than the side close to the outside edge. Here, the above-described constitution is preferable because it is possible to obtain a substantially flat or evenly spread magnetic field which is affected to the first end of the plunger in an orthogonal direction compared to an arc or curved line on which the plunger is rotationally moved. In other words, in the case of such a constitution, it is sufficient even if the magnetic power is small which affects on the first end of the plunger in the above-described orthogonal direction. Therefore, in the case of applying the above-described constitution, it is possible to effectively actuate the plunger even if the electric power is small, and moreover, it is possible to easily control the actuation of the key.

A seventh solution is preferably the above-described key actuating apparatus wherein, the electro magnet comprises first and second electro magnets which are arranged in parallel along a lengthwise direction of the plunger.

The electro magnet to which a current is applied is selectively switched while the first end of the plunger is arranged between a pair of the electro magnets. Therefore, it is possible to easily change the moving direction (actuating direction) of the plunger even if the first end of the plunger is a generally used magnetic material such as iron. Therefore, it is possible to actuate the key in the same direction as and the opposite direction to a pushing direction on the key. For example, it is possible to selectively increase and decrease the reacting force of the key by actuating the key when the key is pushed.

An eighth solution is preferably the above-described key actuating apparatus wherein, the first end of the plunger is formed by using a permanent magnet which has magnetic poles at both ends arranged in the lengthwise direction.

In such a case, it is possible to selectively attract and react to the permanent magnet by switching the direction of a current applied to the same electro magnet. Therefore, it is possible to easily switch the actuation direction of the plunger. Therefore, it is possible to actuate the key in both the same direction as and the opposite direction to a pushing direction on the key.

A ninth solution is preferably the above-described key actuating apparatus, further including a yoke which is formed substantially in a cylindrical shape which covers the outside of the electro magnet.

In accordance with such a constitution, it is possible to obtain a stable magnetic field generated around the electro magnets. Therefore, it is possible to obtain sufficient actuating force to actuate the first end of the plunger even if the current applied to the electro magnet is small, that is, it is possible to actuate the key with a small amount of electric power.

A tenth solution is preferably the above-described key actuating apparatus wherein, the yoke is formed to have a thickness larger at the outside than the inside of the arc shape.

In accordance with such a constitution, even if the electro magnets are constituted by winding the coil wires multiple times so as to be the same cylindrical shape as the plunger, it is possible to obtain an evenly spread magnetic field of the electro magnets from inside to outside of the cylindrical shape. Therefore, for example, in the case in which the plunger is arranged so as to substantially correspond to the center of the cross-section of the electro magnet while the cross section orthogonally crosses the moving direction of the plunger, it is possible to obtain strength of the magnetic field which affects on the first end of the plunger substantially flat or evenly spread in an orthogonal direction to the moving direction of the plunger. Therefore, in the case of applying the above-described constitution, it is possible to effectively actuate the plunger even though the electric power is small, and moreover, it is possible to easily control the actuation of the key.

In accordance with the above-described solutions, even in the case in which the plunger is integrally connected to the key or the weight member, it is possible to actuate the key. Therefore, it is possible to avoid a backlash between the key/weight member and the plunger, and it is possible to improve the touch of the key upon pushing the key.

DETAILED DESCRIPTION OF THE INVENTION

Hereinafter, in reference to FIGS. 1-6, a key actuating apparatus of one embodiment which is an example of the present invention is explained.

Figure 1:
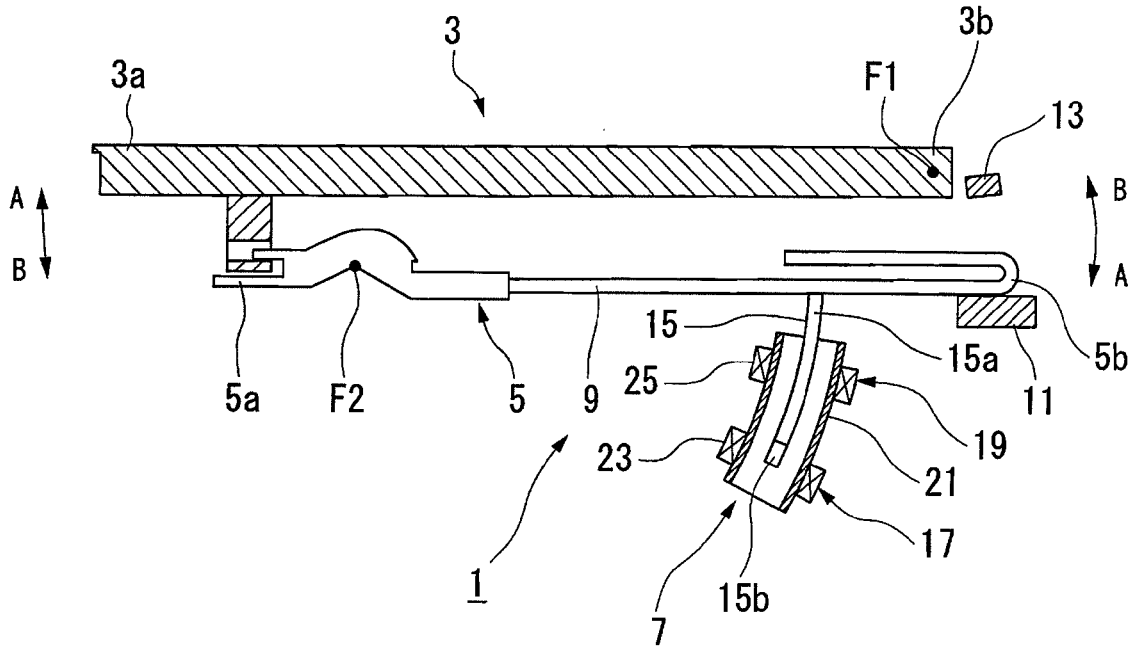
FIG. 1 is a cross section showing an outline of a side face of a key actuation apparatus with regard to one embodiment.

Multiple keys 3 shown in FIG. 1 are actuated by key actuating apparatuses 1 and are arranged in parallel and arranged in a line on a frame (not shown in the drawings) which constitutes a package of a keyboard apparatus such as an electric piano. Each of the keys 3 is supported by a fulcrum axis F1 which is on a side of a rear end 3*b* along a length direction, so as to be rotationally movable in vertical directions.

The key actuating apparatus 1 is provided and corresponds to each of the keys 3. The key actuating apparatus 1 is provided under the key 3 and provides both a rotationally movable lever (weight member) 5 which is substantially in a bar shape and a solenoid 7 which actuates the key 3 and the rotationally movable lever 5.

The rotationally movable lever 5 is arranged so as to have a length direction that corresponds to a longitudinal direction of the key 3, and is supported at an intermediate portion that is a fulcrum axis F2 so as to be rotationally movable. Moreover, a front end portion 5*a* of the rotationally movable lever 5 is connected to a front end portion 3*a* of the key 3. Therefore, the rotationally movable lever 5 is rotationally moved around the fulcrum axis F2 when the key 3 is rotationally moved.

Here, the center of gravity of the rotationally movable lever 5 is closer to a side of the rear end 5*b* rather than the fulcrum axis F2. Therefore, because of the weight of the rotationally movable lever 5, a force is applied on the key 3 in one of the rotational directions (direction A). That is, the rotationally movable lever 5 has the function of a weight, and therefore, it is possible to obtain a touch of the key 3 similar to a natural keyboard musical instrument such as a piano.

Figure 2:
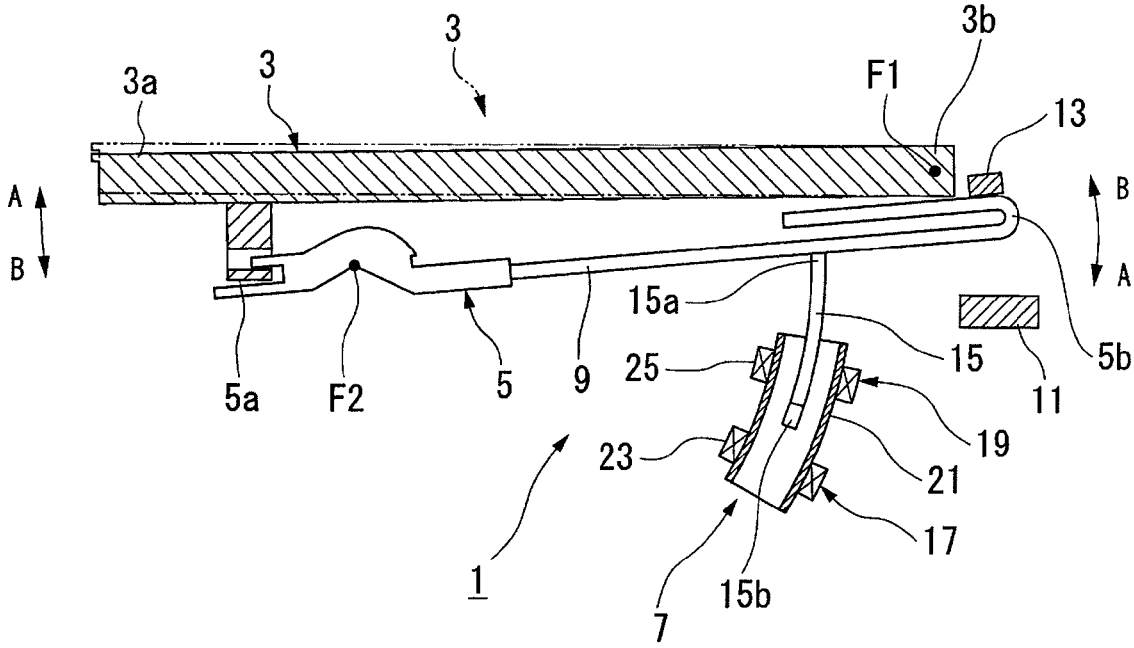
FIG. 2 is a cross section showing an outline of a side face of the key actuation apparatus of FIG. 1 that is in a state in which a key is rotationally moved from an initial position.

Under the rear end 5*b* of the rotationally movable lever 5, a regulation member 11 which is fixed to the frame and which regulates or provides a limitation to rotational motions in the direction A of the key 3 and the rotationally movable lever 5 is provided. Therefore, the rotationally movable lever 5 touches the regulation member 11 because of the weight of the rotationally movable lever 5. Moreover, in the state in which the rotationally movable lever 5 touches the regulation member 11, the key 3 is in an initial position, that is, the key 3 is not moved or operated. Moreover, at the position at which the rear end 5*b* of the rotationally movable lever 5 reaches after rotationally moving in another rotational direction (direction B) from the state of touching the regulation member 11, a regulation member 13 which is fixed to the frame and which regulates or provides a limitation to rotational motions in the direction B of the key 3 and the rotationally movable lever 5 is provided. Furthermore, as shown in FIG. 2, in a state in which the rotationally movable lever 5 is touching the regulation member 13, the key 3 is pushed so as to reach an end position which is a limitation of rotational motion in the direction B (hereinafter, limitation position).

As described above, the regulation members 11 and 13 provide limitations to the range of rotational motion of the key 3 and the rotationally movable lever 5.

The solenoid 7 actuates the key 3 and the rotationally movable lever 5 in the directions A and B. The solenoid 7 includes: a plunger 15 which is fixed to the rotationally movable lever 5, which is formed in an arc or curved shape and which is substantially in a bar shape; and electro magnets 17 and 19 which are fixed to the frame, which can be inserted into by the plunger 15 and which are in substantially a cylindrical shape.

The plunger 15 is integrally fixed to the rotationally movable lever 5 at a portion which is closer to the rear end 5*b* side rather than the fulcrum axis F2 side. Moreover, the plunger 15 protrudes from the rotationally movable lever 5 in the direction B and forms an arc or curved shape around the fulcrum axis F2 of the rotationally movable lever 5. That is, when the rotationally movable lever 5 is rotationally moved, the plunger 15 moves on an arc line around the fulcrum axis F2 of the rotationally movable lever 5 along with a rotational motion of the rotationally movable lever 5, and a lengthwise direction of the plunger 15 corresponds to the direction of such a rotational motion of the plunger 15.

Here, a foot end 15*a* of the plunger 15 which is an end of the plunger 15 (another end) in a lengthwise direction is provided, and it is possible to fix the foot end 15*a* to the rotationally movable lever 5 by, for example, screwing, using an adhesive, welding, by using wax or solder and fitting. Moreover, it is possible to provide screw threads on both the rotationally movable lever 5 and the foot end 15*a* of the rotationally movable lever 5 so as to be screwed and fixed to each other. On the other hand, if both the rotationally movable lever 5 and the plunger 15 are made from the same material, it is possible, for example, to integrally form both the rotationally movable lever 5 and the plunger 15.

Moreover, the plunger 15*b* is made from a non-magnetic material except for a head end (end) 15*b*, and the head end 15*b* is made from a magnetic material such as steel. Furthermore, the diameter of the plunger 15 is approximately the same in the lengthwise direction.

Figure 3:
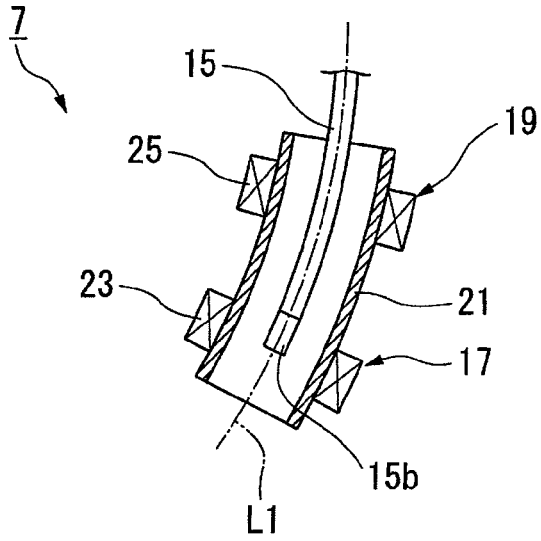
FIG. 3 is an enlarged side face of a solenoid which constitutes the key actuating apparatus of FIG. 1.

Both the electro magnets 17 and 19 are arranged in parallel at separated positions along an arc or curved motion on which the plunger 15 moves (moving direction) due to the rotational motion of the rotationally movable lever 5. The electro magnets 17 and 19 have a constitution including: a bobbin 21 which has a circular or curved shape around a center that is the fulcrum axis F2 of the rotationally movable lever 5, and which is substantially in a cylindrical shape so as to be inserted by the plunger 15; and coil wires (conductor wires for constituting coils) 23 and 25 which are wound around the outside edge of the bobbin 21. The coil wire 23 corresponds to the electro magnet 17, and the coil wire 25 corresponds to the electromagnet 19. Moreover, in this embodiment, as shown in FIG. 3, the plunger 15 is arranged so as to substantially correspond to a center L1 of the cross-section of the bobbin 21 while the cross section orthogonally crosses the lengthwise direction of the plunger 15. Moreover, in this example shown in the drawing, the same bobbin 21 is shared by both electro magnets 17 and 19. However, it is possible to provide a pair of independent bobbins.

Moreover, the head end 15*b* of the plunger 15 moves between the electro magnets 17 and 19 in accordance with the rotational motion of the key 3 and the rotationally movable lever 5. In other words, in the state as shown in FIG. 1 in which the key 3 and the rotationally movable lever 5 are arranged at an initial position, the head end 15*b* of the plunger 15 is arranged at a position close to the electro magnet 17 which is apart from the rotationally movable lever 5. Moreover, in the state as shown in FIG. 2 in which the key 3 and the rotationally movable lever 5 are arranged at the limitation position, the head end 15*b* of the plunger 15 is arranged at a position close to the electro magnet 19 which is closer to the rotationally movable lever 5 rather than the electro magnet 17.

Moreover, the head end 15*b* of the plunger 15 is made from a magnetic material. Therefore, for example, when a current is applied to the first electro magnet 17, a force for actuating the key 3 and the rotationally movable lever 5 in the direction A is applied. On the other hand, for example, when a current is applied to the second electro magnet 19, a force for actuating the key 3 and the rotationally movable lever 5 in the direction B is applied. It should be noted that the force for actuating the key 3 is adjusted in accordance with the degree of the current applied to the electro magnets 17 and 19.

Figure 4:
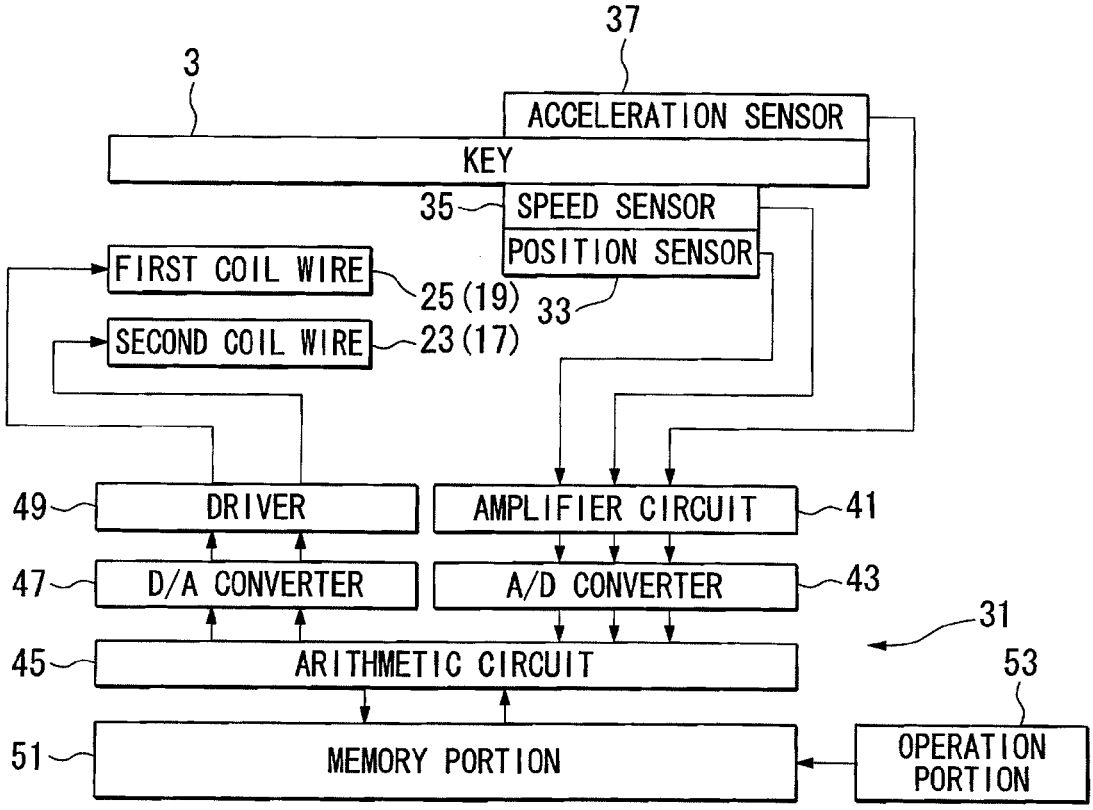
FIG. 4 is a block diagram of another constitution applied to the key actuating apparatus of FIG. 1.

Moreover, in addition to the above-described constitutional elements, as shown in FIG. 4, the key actuating apparatus 1 provides a control unit 31 for controlling actuating operation of each of the keys 3 by controlling application of the current to the electro magnets 17 and 19. The control unit 31 is provided in order to control actuation operations of the keys 3 when a player pushes the keys 3 by his/her hands. Especially the control unit 31 is constituted in order to conduct actuation control so as to realize touch of keys close to a natural keyboard musical instrument such as a grand piano. The control unit 31 includes: a position sensor 33 which detects the position of rotational motion of the key 3; a speed sensor 35 which detects the speed of the rotational motion of the key 3; and an acceleration detection sensor 37 which detects the acceleration of the rotational motion of the key 3.

Moreover, the control unit 31 includes: an amplifier circuit 41; an A/D converter 43; an arithmetic circuit 45; a D/A converter 47; and a driver 49. Therefore, by applying such a constitution, it is possible to control the actuation operation of the key 3 based on an operation status of the key 3 detected by the position sensor 33, the speed sensor 35 and the acceleration sensor 37.

Moreover, the key actuating apparatus 1 includes a memory portion 51 and an operation portion 53, and the memory portion 51 stores profile data with regard to manual pushing operations of keys of a keyboard apparatus and a natural keyboard musical instrument. The profile data shows the relationship between a stroke from an initial position to a limitation position of the key 3 and a reacting force applied to a finger upon pushing the key (see FIG. 6).

It should be noted that the memory portion 51 stores the profile data of the keyboard apparatus (symbol C of FIG. 6) with regard to the case in which the key 3 is not actuated by the key actuating apparatus 1. Moreover, the memory portion stores the profile data of the natural keyboard musical instrument (symbol D of FIG. 6) with regard to multiple types of natural keyboard musical sound instruments. Moreover, such profile data has variety and is stored in correspondence with the speed of pushing a key.

Moreover, by operating the operation portion 53, for example, a player selects the profile data of a predetermined natural keyboard musical instrument among the above-described multiple types of the natural keyboard musical instruments, and modifies the degree of the reacting force, and the like of the profile data of the selected natural keyboard musical instrument. The memory portion 51 stores data inputted by using the operation portion 53.

It should be noted that a selecting operation of the profile data of the natural keyboard musical instrument corresponds to a selecting operation of a pattern of touch of the keys 3. Moreover, a modification operation of the degree of reacting force stored in the profile data of the natural keyboard musical instrument corresponds to, for example, an operation of adjusting strength of feeling of a click which is generated when a hammer roller moves over a lever in an action mechanism of a grand piano.

Figure 6:
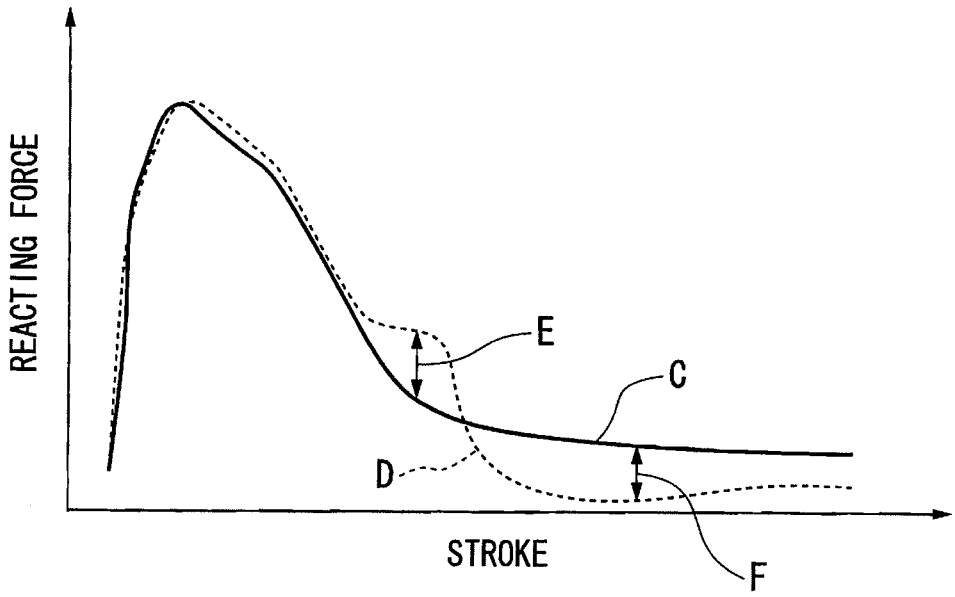
FIG. 6 shows an example of profile data of a keyboard apparatus and a natural keyboard musical instrument stored in a memory portion shown in FIG. 4.

With regard to the keyboard apparatus which has the above-described constitution, before a player pushes the key 3, as shown in FIG. 6, the player inputs various data by selecting a pattern of touch, modifying the degree of reacting force stored in the profile data of the natural keyboard musical instrument, and the like by using the operation portion 53 beforehand (Step S1).

Moreover, for example, when a player pushes the key 3 from an initial position shown in FIG. 1 to a limitation position shown in FIG. 2, the key 3 and the rotationally movable lever 5 are rotationally moved in the direction B. Therefore, the rear end 5*b* of the rotationally movable lever 5 is raised and a finger of the player feels a reacting force while operating or pushing the key 3 because of inertia of the rotationally movable lever 5.

Figure 5:
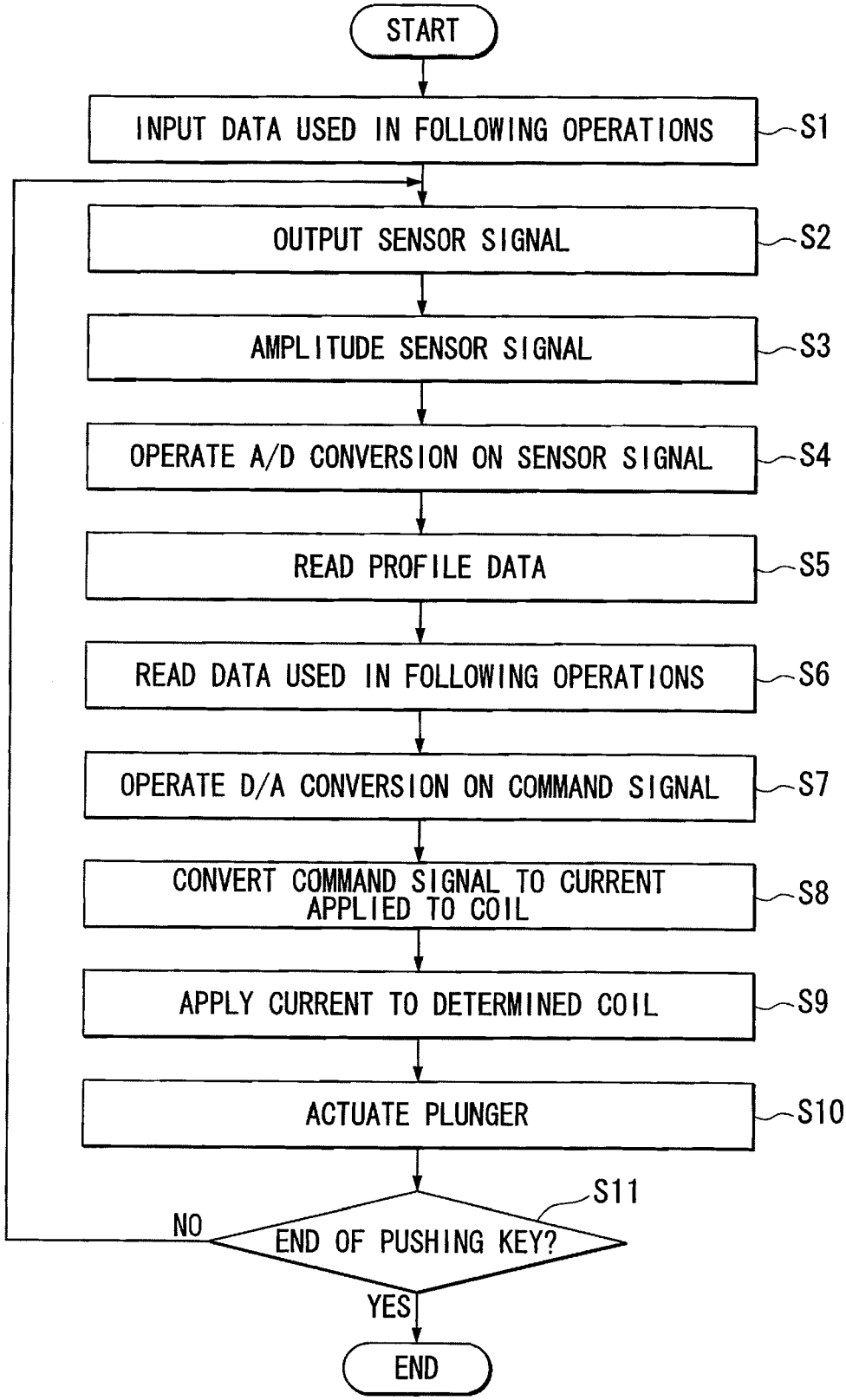
FIG. 5 is a flowchart showing an actuation operation of a key of the key actuating apparatus of FIG. 1.

Moreover, in such an operation, as shown in FIG. 5, the position sensor 33, the speed sensor 35 and the acceleration sensor 37 respectively output sensor signals which indicate the position of rotational motion, the speed of rotational motion and the acceleration of rotational motion of the key 3 to the amplifier circuit 41. The amplifier circuit 41 amplifies the sensor signals (Step S3). After this, the amplified sensor signals are converted to digital signals by the A/D converter 43, and the arithmetic circuit 45 inputs the digital signals (Step S4).

Here, the arithmetic circuit 45 reads the profile data C of the keyboard apparatus and the profile data D of the natural keyboard musical instrument which are appropriate to the speed of rotational motion of the key 3 indicated by the above-described sensor signals (Step S5), and at the same time, reads various data inputted via the operation portion 53 (Step S6). Moreover, the arithmetic circuit 45 adjusts the profile data D of the natural keyboard musical instrument based on the above-described various data.

Moreover, as shown in FIG. 6, if there are differences E and F of the reacting force between the above-described profile data C and D, the arithmetic circuit 45 generates a command signal for applying a current to one of the coil wires 23 and 25 in order to adjust the profile data C of the keyboard apparatus so as to be close to the profile data D of the natural keyboard musical instrument. It should be noted that the value of the current to be applied to the selected coil wire 23 or 25 is included in the command signal.

In a concrete example, if the value of the reacting force of the profile data C of the keyboard apparatus is lower than the value of the reacting force of the profile data D of the natural keyboard musical instrument (the case of a symbol E of an example shown in the drawings), the arithmetic circuit 45 generates the command signal of applying a current to the first coil wire 23 so as to actuate the key 3 in the direction A (applying the reacting force to the key 3) in order to obtain a larger value of reacting force included in the profile data C of the keyboard apparatus. Moreover, the arithmetic circuit 45 calculates the value of the current applied to the first coil wire 23 in order to adjust the value of the reacting force of the profile data C so as to be substantially the same as the value of the reacting force of the profile data D of the natural keyboard musical instrument.

Otherwise, for example, if the value of the reacting force of the profile data C of the keyboard apparatus is higher than the value of the reacting force of the profile data D of the natural keyboard musical instrument (the case of a symbol F of an example shown in the drawings), the arithmetic circuit 45 generates the command signal of applying a current to the second coil wire 25 so as to actuate the key 3 in the direction B (applying an assisting force to the key 3) in order to decrease the value of the reacting force included in the profile data C of the keyboard apparatus. Moreover, the arithmetic circuit 45 calculates the value of the current applied to the second coil wire 25 in order to adjust the value of the reacting force of the profile data C so as to be substantially the same as the value of the reacting force of the profile data D of the natural keyboard musical instrument.

After this, as shown in FIG. 5, the arithmetic circuit 45 outputs the command signal calculated in the above-described operations to the D/A converter 47, and the D/A converter 47 converts the command signal to an analog signal (Step S7) and outputs the analog signal to the driver 49. Finally, the driver 49 converts the command signal, that is, the inputted analog signal, to a current which is applied to the coil wire 23/25 (Step S8), and the driver 49 applies the current to the coil wire 23/25 in accordance with the command signal (Step S9).

Therefore, the plunger 15 is actuated so as to move in a direction in accordance with the command signal (Step S10), and it is possible to obtain a touch of the key 3 that is very close to the natural keyboard musical instrument. It should be noted that after Step S10, the arithmetic circuit 45 detects whether or not the pushing operation on the key 3 by the player is finished based on a sensor signal from the position sensor 33 (Step S11). Moreover, if the arithmetic circuit 45 detects that the key 3 does not return to the initial position, the operation of Step S2 is repeated. Furthermore, if the arithmetic circuit 45 detects that the key 3 has returned to the initial position, the actuation control with regard to the key 3 is finished.

As described above, by using the key actuating apparatus 1 of this embodiment, when a current is applied to the coil wire 23/25 of the electro magnet 17/19, a magnetic force of the electro magnet 17/19 affects on the head end 15*b* of the plunger 15. Therefore, the plunger 15 is moved on an arc or curved line, and the key 3 is actuated. Here, the plunger 15 is formed in an arc or curved shape which is corresponding to the rotational motion of the rotationally movable lever 5. Therefore, if the plunger 5 is integrally formed with the rotationally movable lever 5, it is possible to insert the plunger 15 into the bobbin 21 which constitutes the electro magnets 17 and 19 in a cylindrical shape.

Moreover, if the key is manually pushed, the plunger 15 which has an arc or curved shape moves on an arc or curved line in accordance with the rotational motion of the key 3. Therefore, in the same manner as described above, it is possible to insert the plunger 15 into the bobbin 21 which constitutes the electro magnets 17 and 19 in a cylindrical shape.

In accordance with the above-described key actuating apparatus 1, it is possible to avoid a backlash between the rotationally movable lever 5 and the plunger 15, and it is possible to improve the touch of the key 3 upon pushing the key 3.

Moreover, the electro magnets 17 and 19 are arranged along an arc or curved line on which the plunger 15 rotationally moves, and the coil wire 23/25 of the electro magnet 17/19 to which a current is applied is selectively switched while the head end 15*b* of the plunger 15 is arranged between the electro magnets 17 and 19. Therefore, it is possible to easily change the direction in which the plunger 15 is actuated even if the head end 15*b* of the plunger 15 is a generally used magnetic material such as iron. Therefore, it is possible to actuate the key 3 in the same direction (direction B) as and the opposite (direction A) direction to a pushing direction on the key 3. In other words, as described above, it is possible to selectively increase and decrease the reacting force of the key 3 by actuating the key 3 when the key 3 is pushed.

Figure 7:
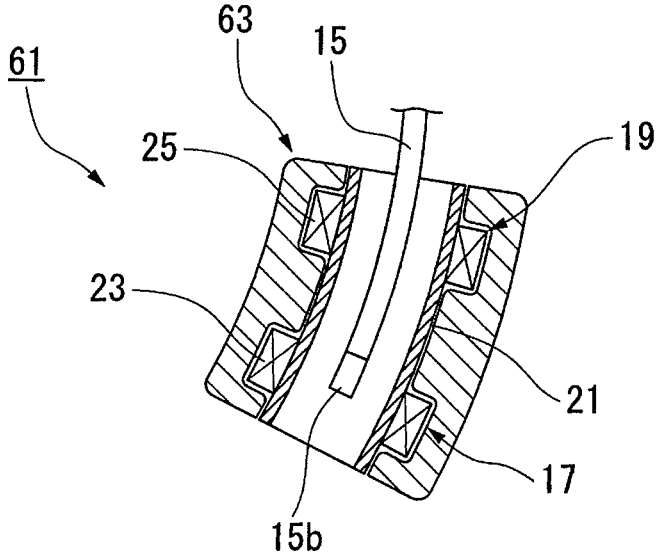
FIG. 7 is an enlarged side face of a solenoid which constitutes the key actuating apparatus of another embodiment.

It should be noted that in the above-described embodiment, the solenoid 7 includes the plunger 15 and a pair of the electro magnets 17 and 19. However, this is not a limitation. For example, as shown in FIG. 7, in addition to such constitutional elements, it is possible to provide a yoke 63 which is made from a magnetic material such as iron and which is substantially formed in a cylindrical shape so as to cover the outside of the electro magnets 17 and 19.

In accordance with such a constitution, it is possible to obtain a stable magnetic field generated around the coil wires 23 and 25 of the electro magnets 17 and 19. Therefore, it is possible to obtain sufficient actuating force to actuate the head end 15*b* of the plunger 15 even if the current applied to the coil wires 23 and 25 is small, that is, it is possible to actuate the key 3 with a small amount of electric power. Moreover, in accordance with such a constitution of a solenoid 61, compared to the solenoid 7 of the above-described embodiment, it is possible to reduce the current applied to the coil wires 23 and 25 so as to be approximately from a half to one third.

It should be noted that in the above-described constitution, only one yoke 63 is formed so as to cover both the electro magnets 17 and 19. However, this is not a limitation, and for example, it is possible to form a pair of yokes which independently covers the electro magnets 17 and 19.

Figure 8:
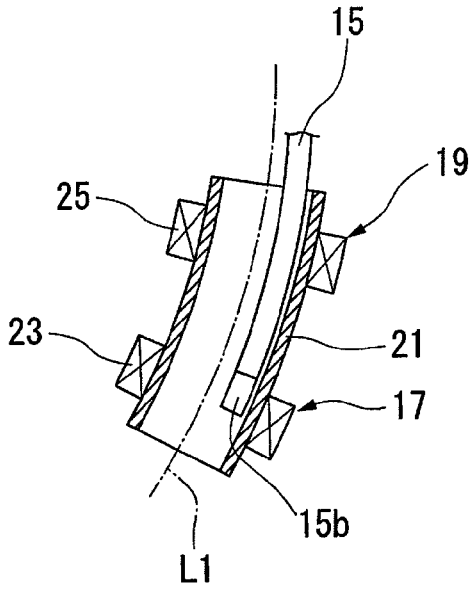
FIG. 8 is an enlarged side face of a solenoid which constitutes the key actuating apparatus of another embodiment.

Moreover, in the above-described embodiment, the plunger 15 is arranged so as to substantially correspond to the center L1 of the cross section of the bobbin 21 while the cross section orthogonally crosses the lengthwise direction of the plunger 15. However, this is not a limitation, and for example, as shown in FIG. 8, it is preferable to arrange the plunger 15 rather outside from the center L1 of the bobbin 21 which is formed in an arc or curved shape.

In a case in which each of the electro magnets 17 and 19 is constituted by winding the coil wire 23 or 25 multiple times in order to provide a coil so as to be the same cylindrical shape as the plunger 15, the density of the coil of each of the electro magnets 17 and 19 is different between a side close to an inside edge and a side close to a peripheral edge of the cylindrical shape. Therefore, the magnetic field strength of the electro magnets 17 and 19 at the side close to the inside edge is stronger than the side close to the outside edge. The above-described constitution is preferable because it is possible to obtain a substantially flat or evenly spread magnetic field which is affected to the head end 15*b* of the plunger 15 in an orthogonal direction compared to an arc or curved line on which the plunger 15 is rotationally moved. In other words, in the case of arranging the plunger 15 as described above, it is sufficient even if the magnetic power of the electro magnets 17 and 19 is small which affects on the head end 15*b* of the plunger 15 in the above-described orthogonal direction. Therefore, in a case of applying the above-described constitution, it is possible to effectively actuate the plunger 15 even if the electric power is small, and moreover, it is possible to easily control the actuation of the key 3.

Figure 9:
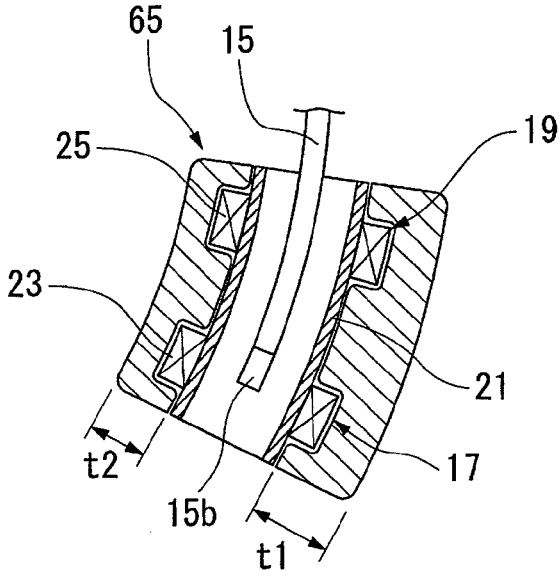
FIG. 9 is an enlarged side face of a solenoid which constitutes the key actuating apparatus of another embodiment.

It should be noted that there is another example of a constitution which has the same advantage as described above. For example, as shown in FIG. 9, a yoke 65 is provided which is made from a magnetic material and which is substantially formed in a cylindrical shape so as to cover the outside of the electro magnets 17 and 19, and moreover, a thickness t1 of the yoke 65 close to an outside edge of the arc or curved shape is formed so as to be larger than a thickness t2 of the yoke 65 close to an inside edge.

In accordance with such a constitution, even if the electro magnets 17 and 19 are constituted by winding the coil wires 23 and 25 multiple times so as to be the same cylindrical shape as the plunger 15, it is possible to obtain an evenly spread magnetic field of the electro magnets 17 and 19 from inside to outside of the cylindrical shape. Therefore, for example, in the case in which the plunger 15 is arranged so as to substantially correspond to a center L1 of a cross-section of the bobbin 21 while the cross section orthogonally crosses a lengthwise direction of the plunger 15, it is possible to obtain strength of the magnetic field which affects on the head end 15*b* of the plunger 15 substantially flat or evenly spread in an orthogonal direction to a lengthwise direction of the plunger 15. Therefore, as described above, it is possible to effectively actuate the plunger 15 even if the electric power is small, and moreover, it is possible to easily control the actuation of the key 3.

Figure 10:
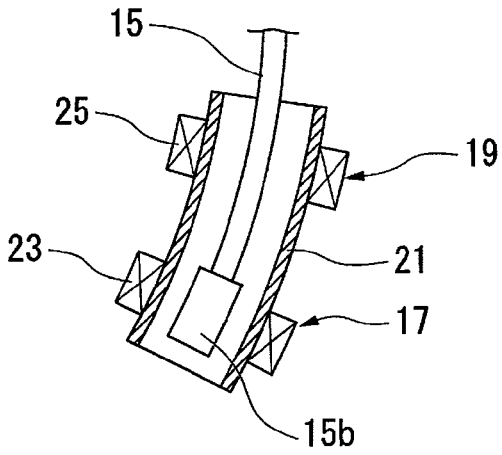
FIG. 10 is an enlarged side face of a solenoid which constitutes the key actuating apparatus of another embodiment.
Figure 11:
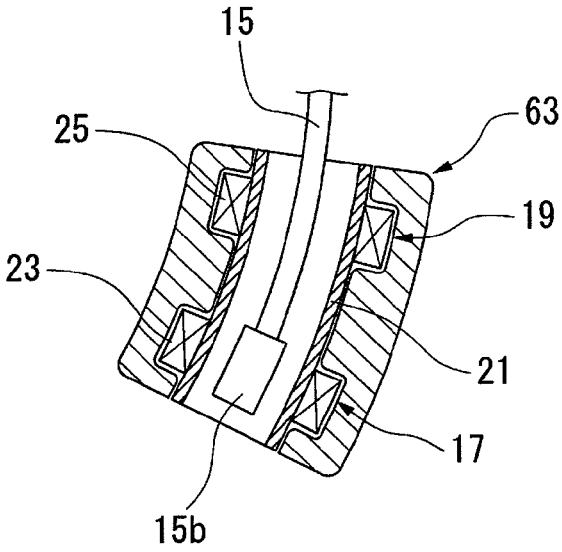
FIG. 11 is an enlarged side face of a solenoid which constitutes the key actuating apparatus of another embodiment.

Otherwise, in the above description, the diameter of the plunger 15 is substantially the same in the lengthwise direction. However, as shown in FIGS. 10 and 11, it is possible to form the head end 15*b* of the plunger 15 so as to have a larger diameter compared to other portions of the plunger 15.

In such a case, even in the case in which the overall plunger 15 is made from the magnetic body, the magnetic force of each of the electro magnets 17 and 19 affects most strongly on the head end 15*b* of the plunger 15. Therefore, it is possible to reliably actuate the plunger 15 by using the magnetic force of the electro magnets 17 and 19. Moreover, because the overall plunger 15 is formed by applying the magnetic body, it is possible to easily manufacture by dyeing or stamping, forging, and the like, and therefore, it is possible to improve productivity and reduce production cost of the key actuating apparatus and the keyboard musical instrument.

Moreover, in the case of forming the overall plunger 15 by applying the magnetic body, it is possible to integrally form the plunger 15 including the rear end 5*b* of the rotationally movable lever 5, for example, by forming a portion of the rotationally movable lever 5 closer to the rear end 5*b* rather than the fulcrum axis F2 by applying a magnetic body such as steel, and therefore, it is possible to easily produce such portions.

As described above, both the solenoids 7 and 61 have the electro magnets 17 and 19. However, this is not a limitation, and it is possible to apply other constitutions if the key 3 can be actuated in both directions A and B.

Figure 12:
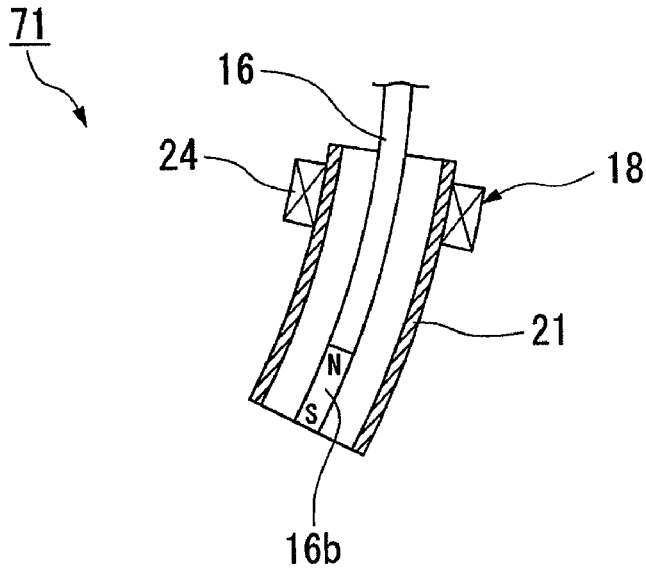
FIG. 12 is an enlarged side face of a solenoid which constitutes the key actuating apparatus of another embodiment.

Therefore, as shown in FIG. 12, it is possible to apply a solenoid 71 including: a bobbin 21 which is the same as the above-described embodiment; one electro magnet 18 which is made from a coil wire 24 wound around the outside of the bobbin 21; and a plunger 16 which is formed in an arc or curved shape and which is inserted inside the bobbin 21. Moreover, in this constitution, the plunger 16 has a head end 16*b* made from a permanent magnet which has a pair of magnetic poles arranged at both ends in a lengthwise direction of the head end 16*b*.

In such a case, it is possible to selectively attract and react to the head end 16*b* of the plunger 16 which is made from the permanent magnet by switching the direction of the current applied to the coil wire 24 of the electro magnet 18. Therefore, it is possible to easily switch the actuation direction of the plunger 16. In other words, in such a constitution, it is possible to actuate the key 3 in both directions A and B.

It should be noted that in order to conduct actuation control of the solenoid 71 of this constitution by using the control unit of the above-described embodiment, the arithmetic circuit 45 generates a command signal including a direction and a level of the current applied to the coil wire 24, and the driver 49 applies a current of the direction and level in accordance with the command, so as to reduce the differences E and F (see FIG. 6) of the reacting force between the profile data C and D of the keyboard apparatus and the natural keyboard musical instrument.

For example, in a case in which the plunger 16 is arranged in a manner as shown in an example of the drawings, if the reacting force indicated by the profile data C of the keyboard apparatus is lower than the reacting force indicated by the profile data D of the natural keyboard musical instrument (the case of a symbol E shown in the examples of FIG. 6), it is possible to apply a current to the coil wire 24 in the first direction in order to react the plunger 16 by using the magnetic force of the electro magnet 18. Moreover, for example, if the reacting force indicated by the profile data C of the keyboard apparatus is higher than the reacting force indicated by the profile data D of the natural keyboard musical instrument (the case of a symbol F shown in the examples of FIG. 6), it is possible to apply a current to the coil wire 24 in the second direction which is opposite to the first direction in order to attract the plunger 16 by using the magnetic force of the electro magnet 18.

Figure 13:
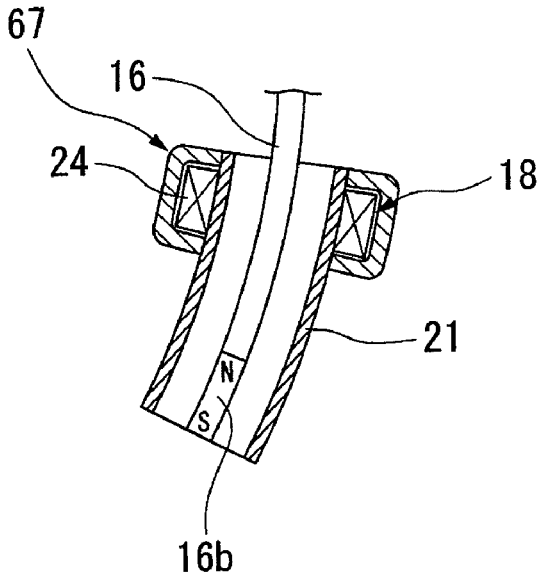
FIG. 13 is an enlarged side face of a solenoid which constitutes the key actuating apparatus of another embodiment.

Otherwise, even in a constitution in which only one electro magnet 18 is provided, for example, as shown in FIG. 13, by providing a yoke 67 which is formed substantially in a cylindrical shape so as to cover the outside of the coil wire 24 of the electro magnet 18, it is possible to reduce the current applied to the coil wire 24 so as to be in a range from a half to one third in comparison to the solenoid 71 shown in FIG. 12.

Moreover, in the above-described embodiment, the foot end 15*a* of the plunger 15/16 which constitutes the solenoid 7, 61 and 71 is fixed to the rotationally movable lever 5. However, such a constitution is not a limitation, and it is possible to apply another constitution in which the plunger 15/16 is arranged so as to rotationally move in accordance with a rotational motion of the key 3 and is formed in an arc or curved shape extending along the path of rotational motion.

Figure 14:
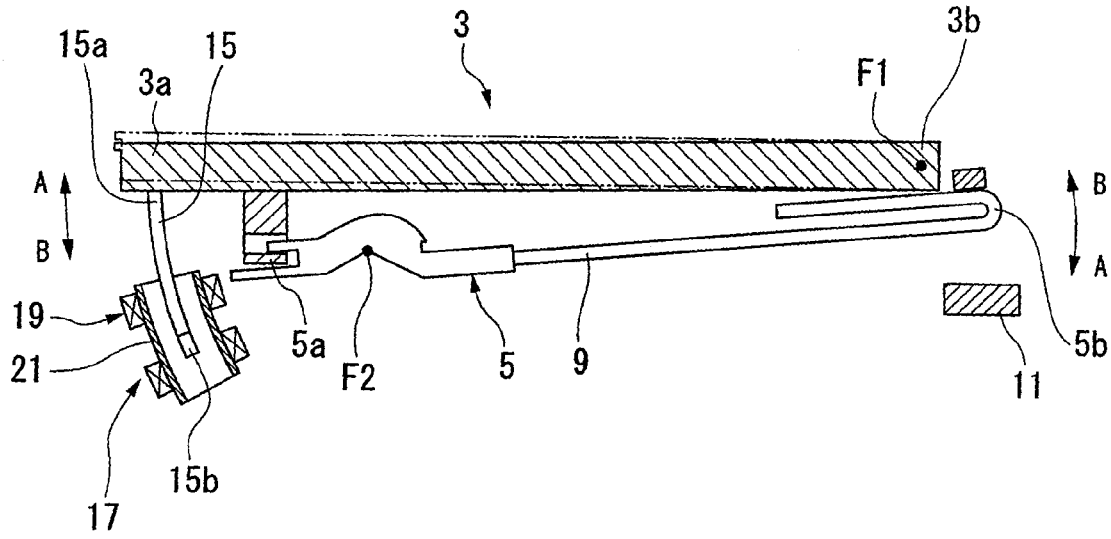
FIG. 14 is a cross section showing an outline of a side face of a key actuation apparatus with regard to another embodiment.

In other words, for example, as shown in FIG. 14, it is possible to apply a constitution in which the foot end 15*a* of the plunger 15 is integrally fixed to a front end 3*a* of the key 3. In such a case, it is possible to provide the plunger 15 and the bobbin 21 formed in an arc or curved shape around the fulcrum axis F1 of the key 3 as a center, and it is possible to arrange the electro magnets 17 and 19 at positions into which the plunger 15 is inserted. Moreover, in the same manner as the above-described embodiment, it is possible to fix the foot end 15*a* of the plunger 15 to the key 3 by, for example, screwing, using an adhesive, welding, by using wax or solder and fitting.

In the case of applying the constitution, even though the plunger 15 is integrally fixed to the key 3 as described above, it is possible to insert the plunger 15 inside the bobbin 21 because the plunger 15 is formed in an arc or curved shape so as to fit a rotational motion of the key 3. Therefore, it is possible to avoid a backlash between the rotationally movable lever 5 and the plunger 15, and it is possible to improve the touch of the key 3 upon pushing the key 3.

Figure 15:
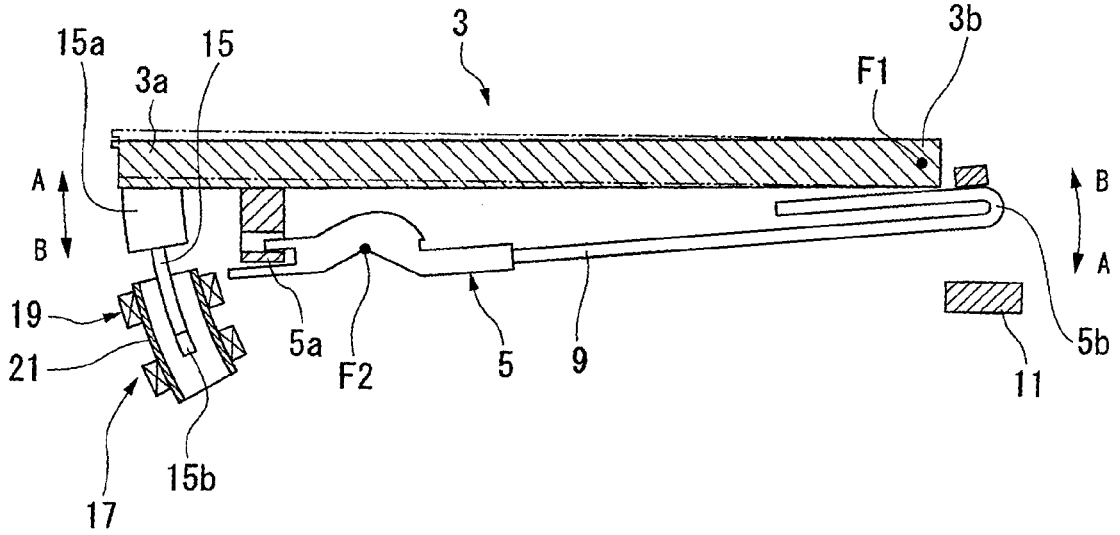
FIG. 15 is a cross section showing an outline of a side face of a key actuation apparatus with regard to another embodiment.

In addition, if the plunger 15 is integrally fixed to the key 3, it is possible to apply a constitution in which the plunger has a certain weight which applies a force to the key 3 in another direction of a rotational motion (direction B). In accordance with such a constitution, the plunger 15 has a function of a counterweight with regard to the rotationally movable lever 5. In addition, due to the weight including both the rotationally movable lever 5 and the plunger 15, an inertia of a whole system including the key 3 and the rotationally movable lever 5 is increased. Therefore, without fixing another weight member to the key 3, it is possible to improve the touch or the feeling of weight while pushing the key 3 with a finger, and it is possible to improve the feeling of the player while playing the keyboard musical instrument. It should be noted that, in order to maintain a static weight upon pushing the key by a player, it is possible to increase the weight of the rotationally movable lever 5 in accordance with the increased weight of the plunger 15. In order to effectively increase the weight of the plunger 15, as a concrete solution, for example, as shown in FIGS. 10 and 11, it is possible to increase the diameter of the head end 15*b* of the plunger 15 compared to other portions. However, there is another solution in which, for example, as shown in FIG. 15, it is possible to increase the diameter of the foot end 15*a* of the plunger 15 compared to other portions. It should be noted that there is a limitation for increasing the diameter of the head end 15*b* of the plunger 15 due to an inside diameter of the bobbin 21. Therefore, it is possible to effectively increase the weight of the plunger by increasing the diameter of the foot end 15*a* which is not inserted into the bobbin 21 while the key 3 is being pushed.

It should be noted that in order to increase an inertia of the key 3, it is effective if a weight member is provided as close to the front end 3*a* of the key 3 as possible. In addition, if the plunger 15 is provided close to the front end 3*a* of the key 3, an advantage can be obtained in which a small force generated by the solenoid 7, 61 or 71 is sufficient for actuating the key 3. It is preferable to arrange the front end portion (connection portion) 5*a* of the rotationally movable lever 5 close to the front end 3*a* of the key 3. Due to such reasons, there is a tendency in which many constitutional portions of the key actuating apparatus are gathered close to the front end 3*a* of the key 3. However, if the plunger 15 is constituted as a weight and has multiple functions, it is possible to avoid from wasting space at the front end 3*a* of the key 3.

Moreover, in the above-described embodiment, the control unit 31 is a motion detection sensor which detects the motion and status of the key 3 and which provides the position sensor 33, the speed sensor 35 and the acceleration sensor 37. However, this is not a limitation and it is possible that the control unit 31 provide one of these constitutional elements. That is, for example, in the case in which the control unit 31 provides only the position sensor 33, it is possible to calculate the speed and acceleration of the rotational motion of the key 3 by calculating the differential of the position of the rotational motion of the key 3.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A key actuating apparatus for actuating a key that is rotationally movable and is supported and attached to a frame, said apparatus comprising:

a plunger that is rotationally movable in correspondence with a rotational motion of the key, and which is formed in an arc shape extending in a direction of a rotational motion of the plunger, said plunger formed in an arc shape around a fulcrum axis of a rotational motion of the key;

a solenoid affixed to the frame and having an electro magnet that is substantially in a cylindrical shape, wherein the plunger is positioned inside the solenoid; and a weight member that is linked to the key, and is supported and rotationally movable in response to rotational motion of the key, wherein a first end of the plunger in a lengthwise direction comprises a magnetic body, wherein a second end of the plunger is fixed to the key by being integrally formed with the key, wherein said weight member applies a force on the key in a predefined direction, and wherein the plunger applies a force on the key in another direction due to weight of the plunger.

2. A key actuating apparatus according to claim 1 wherein, the first end of the plunger has a larger diameter than a diameter of other portions of the plunger.

3. A key actuating apparatus according to claim 1 wherein, the plunger is longitudinally arranged at a position that is a distance away from a center of a cross-section of the electro magnet.

4. A key actuating apparatus according to claim 1 wherein, the electro magnet includes a first and a second electro magnets that are arranged in parallel along a lengthwise direction of the plunger.

5. A key actuating apparatus according to claim 1 wherein, the first end of the plunger includes a permanent magnet having magnetic poles at both ends arranged in the lengthwise direction.

6. A key actuating apparatus according to claim 1, further comprising a yoke which is formed substantially in a cylindrical shape which covers an outside of the electro magnet.

7. A key actuating apparatus according to claim 6 wherein, the yoke is formed to have a thickness larger at an outside than an inside of the arc shape.

* * * * *